United States Patent [19]

Taketomi

[11] 4,333,410

[45] Jun. 8, 1982

[54] SEWING MACHINE

[76] Inventor: Bunsaku Taketomi, 56-141 aza-Ishikane, ohaza-Iwasaki, Nisshin-cho, Aichi-gun, Aichi-ken, Japan

[21] Appl. No.: 128,983

[22] Filed: Mar. 10, 1980

Related U.S. Application Data

[63] Continuation of Ser. No. 951,709, Oct. 13, 1978, abandoned.

[51] Int. Cl.[3] ..... D05B 1/14; D05B 1/20

[52] U.S. Cl. ..... 112/162; 112/168; 112/259

[58] Field of Search ..... 112/162, 168, 163, 167, 112/164, 165, 166, 177, 258, 259

[56] References Cited

U.S. PATENT DOCUMENTS

| | | | |
|---|---|---|---|
| 877,508 | 1/1908 | Klemm | 112/163 X |
| 1,917,756 | 7/1933 | Eames | 112/163 X |
| 2,834,309 | 5/1954 | Russell et al. | 112/163 |
| 2,973,730 | 3/1961 | Schweda et al. | 112/163 |
| 3,342,150 | 7/1967 | Tretou et al. | 112/163 |
| 3,353,510 | 11/1967 | Reeber et al. | 112/163 |

FOREIGN PATENT DOCUMENTS

| | | | |
|---|---|---|---|
| 160948 | 4/1921 | United Kingdom | 112/163 X |

*Primary Examiner*—H. Hampton Hunter
*Attorney, Agent, or Firm*—William A. Drucker

[57] ABSTRACT

A machine body of -shape as viewed in front is formed of a bed, an arm frame laterally disposed above the bed, and an upright support uprightly extended from the bed and supporting one end of the arm frame at an upper end thereof. An upper mechanism of a locking stitching sewing mechanism is disposed in the free end of the arm frame and a lower mechanism of the lockstitching sewing mechanism is disposed below the upper mechanism within the bed so that cloth may be subjected to lockstitching by these mechanisms. An overedge stitching mechanism is provided in a recess within the ]-shaped body in order to apply overedge to the edge of the cloth.

7 Claims, 12 Drawing Figures

SEWING MACHINE

This is a continuation of Ser. No. 951,709 filed Oct. 13, 1978, now abandoned.

BACKGROUND OF THE INVENTION

1. Field of the Invention

This invention relates to a sewing machine for sewing pieces of cloth.

2. Description of the Prior Art

When pieces of cloth are sewn together to make clothing, it is necessary, even in the making of a single article of clothing, to select the way of sewing suitable for a variety of sewing types. That is, for example, when an edge of a piece of cloth is stitched, overedge stitching is employed, and on the other hand, when a plurality of pieces of fabric are sewn together, lockstitching is employed. Because of such stitching requirements, if two sewing machines, one for the lockstitching and the other for the overlock sewing, have to be accommodated for example in an ordinary household, it poses a problem that these machines occupy a very large space when they are put in a house-work room.

In addition, when articles of clothing are made in the household, there is often involves the procedure of applying the overedge stitching to a first portion thereof, thereafter the overedge stitching to a second portion, and the overlock sewing to a third portion, and thereafter again the lockstitching thereto. In such case, if an attempt is made to perform sewing using two different sewing machines, the operation, in which an operator leaves one seat and takes the other seat where sewing takes place and thereafter the operator returns to the first seat for sewing, must be repetitiously conducted.

SUMMARY OF THE INVENTION

It is therefore an object of the present invention to provide a sewing machine in which two modes of sewing, one for lockstitching and the other for overedge stitching can be achieved by a single sewing machine.

It is a further object of the present invention to provide a sewing machine in which even in the case where the two modes of sewing as described above are alternately carried out, either way of sewing may be immediately conducted by only slight movement of the hand.

It is another object of the present invention to provide a sewing machine of a compact style externally similar to conventional sewing machines which can merely perform a single way of sewing, despite the fact that the proposed sewing machine may perform two modes of sewing as previously mentioned.

Other objects and advantages of the invention will become apparent during the following discussion of the accompanying drawings.

DESCRIPTION OF THE PREFERRED EMBODIMENTS

Figure 1:
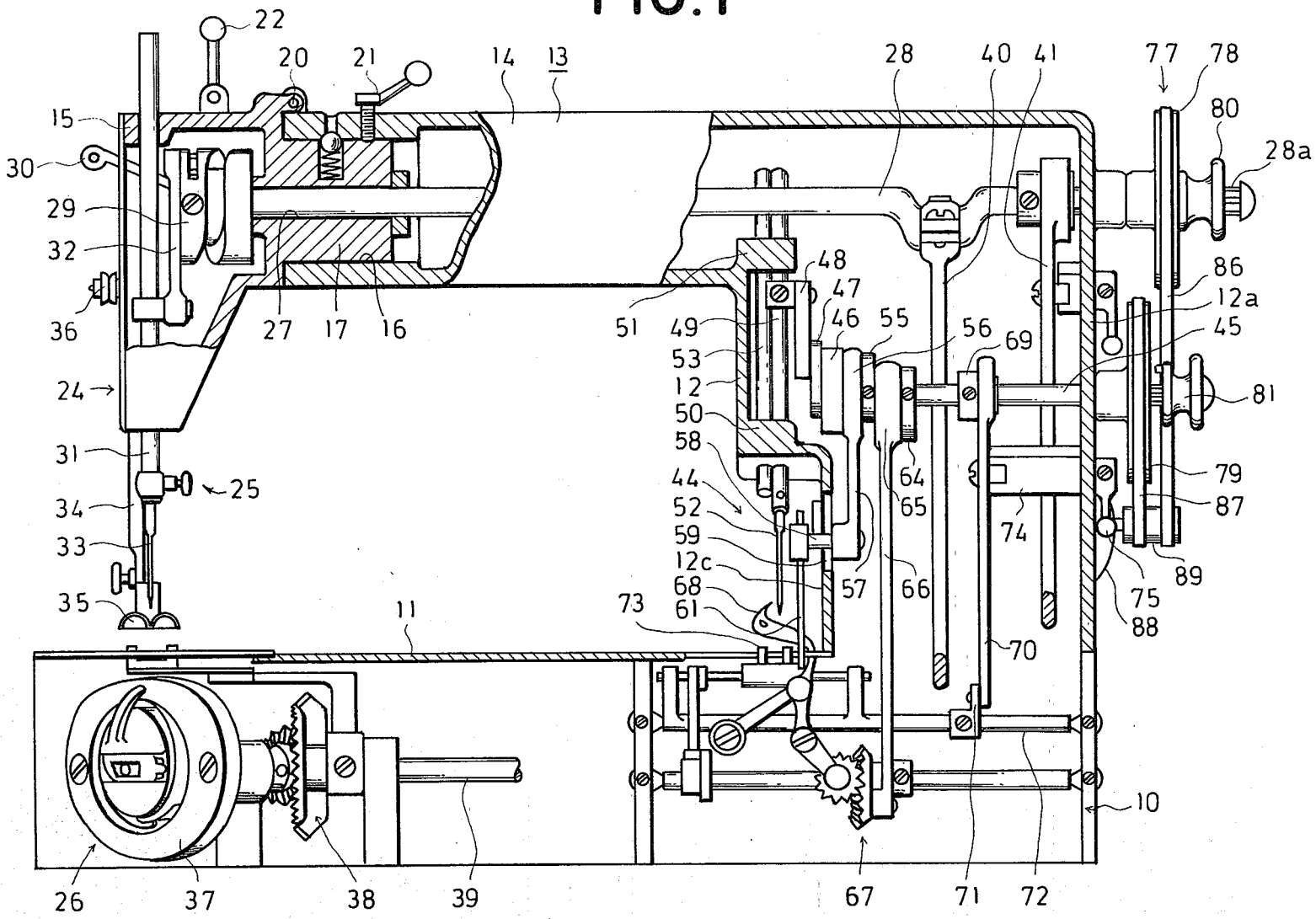
FIG. 1 is a front view, partly in section, of a sewing machine.
Figure 2:
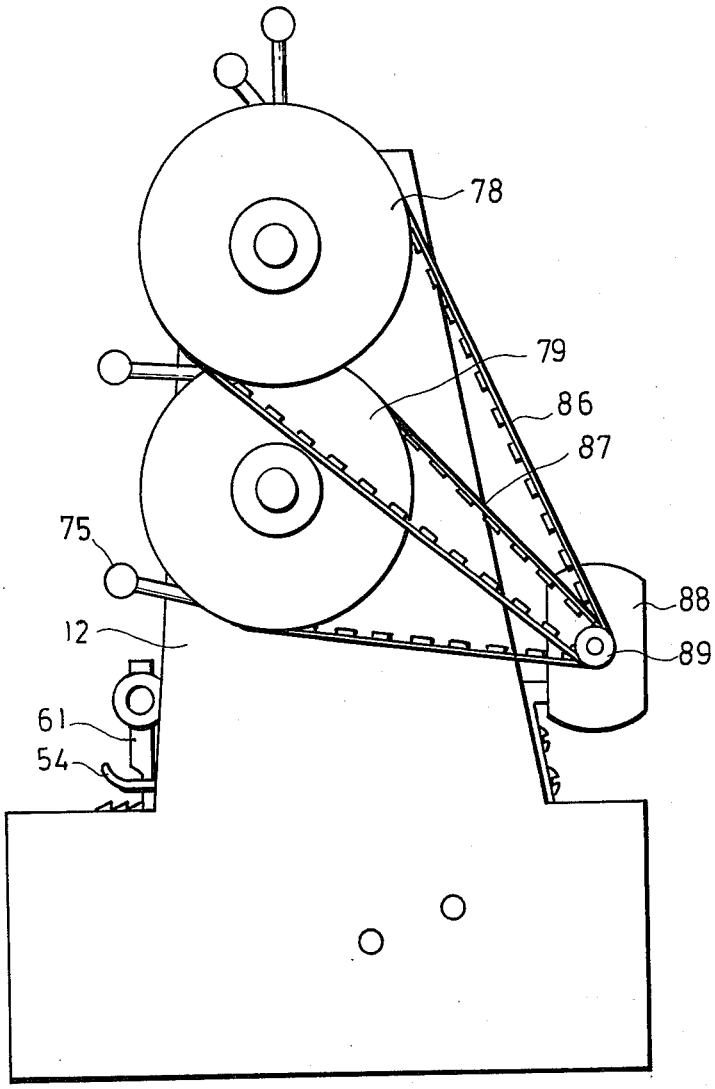
FIG. 2 is a side view on the right side.
Figure 3:
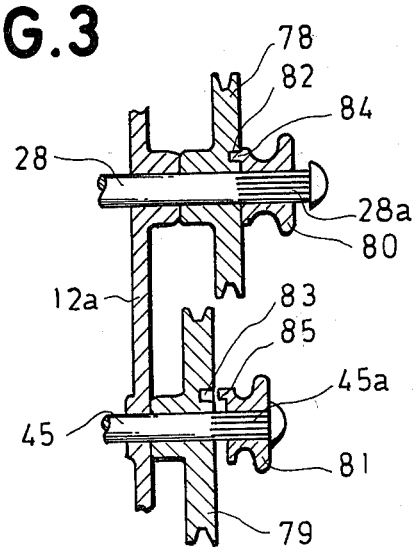
FIG. 3 is a longitudinal sectional view of a selecting mechanism.

Referring now to FIGS. 1 through 6, the reference numeral 10 designates a machine frame of the entire sewing machine. This machine frame 10 comprises a bed 11, an upright support 12 uprightly extended from the bed 11, and an arm frame 13 extended parallel with the upper surface of the bed 11 from the upper end of the upright support 12. The arm frame 13 comprises an arm frame body 14 integral with the upright support 12 and a head 15 connected to the foremost end of the arm frame body 14. The head 15 is rotatably mounted on the arm frame body 14. That is, the arm frame body 14 is formed at its foremost end with a bearing hole 16 whereas the head 15 has a shank 17, which is rotatably received in the bearing hole 16. In a connection between the arm frame body 14 and the head 15, the arm frame body 14 has a projection 18 extended therefrom, which projection 18 threadedly receives an adjusting screw 19. On the other hand, the head 15 has a stop 20 attached thereto. When the stop 20 bears on the tip of the adjusting screw 19, a needle in the lockstitching mechanism later described herein is properly opposed to a shuttle also later described herein. It should be noted that the arm frame body 14 is provided with a fastening handle 21 used to lock the head 15 which is in turn provided with a handle 22 for rotation and operation thereof.

Next, a lockstitching mechanism 24 will be described. The lockstitching mechanism 24 comprises an upper mechanism 25 disposed in the head 15 and a lower mechanism 26 disposed interiorly of the bed 11. These are constructed similarly to a conventional sewing machine. Namely, in the upper mechanism 25, an arm shaft 28 for lockstitching is inserted in a hole 27 bored in a central position of the shank 17, and a thread take-up cam 29 is mounted on one end of the arm shaft 28. The cam 29 has a thread take-up lever 30 connected thereto. The head 15 has a needle bar 31, with a needle 33 attached to a lower end thereof, mounted thereon and movable up and down. The needle bar is needle-bar connected to the cam 29 through a connecting rod 32. The head 15 is provided with a presser bar 34 movable up and down, the presser bar 34 having a presser foot 35 attached to a lower end thereof. The head 15 further has a thread tension regulator 36 mounted on the outer surface thereof. Next, in the lower mechanism 26,a shuttle 37 is positioned below the needle bar 31 in the upper mechanism 25. The shuttle 37 has a shuttle driving mechanism 38 connected thereto, which in turn has an oscillating driving shaft 39 connected thereto. The driving shaft 39 is connected to the arm shaft 28 through connecting rods 40 and 41. Accordingly, when the shaft 28 rotates, the needle bar 31 moves up and down and the shuttle 37 also turns in association therewith, whereby a needle thread passed through the needle 33 cooperates with a bobbin thread within the shuttle 37 to effect lockstitching of clothes.

An overedge stitching mechanism 44 will now be described. This overedge stitching mechanism 44 is also constructed similarly to a mechanism of a conventional overedge stitching machine. That is, the upright support 12 is interiorly provided with an overedge stitching spindle 45 which is laterally supported in a side wall 12*a* and a bearing member 46. A rotary plate 47 is mounted on one end of the spindle 45 and one end of a crank rod 48 is pivotally mounted at an eccentric position of the rotary plate 47. The crank rod 48 has the other end connected to a needle bar 49 which is supported movably up and down on supporting members 50 and 51. Thus, when the spindle 45 rotates, the needle bar 49 moves up and down in association therewith. It will be noted that a needle 52 is attached to the lower end of the needle bar 49.

An eccentric 55 is secured to the spindle 45 and an annular member 56 fits in an outer peripheral surface of the eccentric 55. A suspending rod 57 is integrally connected to the annular member 56. A transmission rod 58 connected to the lower end of the rod 57 extends externally of the upright support 12 passing through a slot 59 bored through a side wall 12*c* in the form of a concavity in the upright support 12 and is connected to a midportion of an oscillatory arm 60 having one end pivotally mounted on the side wall 12*c*. The oscillatory arm 60 has a cloth cutting edge 61 attached to the other end thereof.

With this construction, when the spindle 45 rotates, the oscillatory arm 60 is oscillated up and down through the rod 57 so that the cloth cutting edge 61 may cut an edge of an article of clothing to be overedge stitched.

Also, an eccentric 64 is secured to the spindle 45 and an annular member 65 fits in an outer peripheral surface of the eccentric 64. A suspending rod 66 is integrally connected to the annular member 65. The rod 66 has its lower end connected to a looper driving member 67 so that when the spindle 45 rotates to move the rod 66 up and down, the looper driving member 67 is actuated and a looper 68 is then operated in association therewith.

Further, a triangular cam 69 is secured to the spindle 45. An upper end of a bifurcated rod 70 is opposedly close to the triangular cam 69. A lower end of the bifurcated rod 70 is brought into association, in a known manner, with a feed dog 73 exposed at the upper surface of the bed 11, through a lever 71, a shaft 72 and the like. Accordingly, when the spindle 45 rotates to cause the needle bar 49, the cloth cutting edge 61 and the looper 68 to actuate, the feed dog is 73 is also associated therewith to effect the cloth feeding operation. It will be noted that a feed-amount setter 74 is connected to a midportion of the bifurcated rod 70 so that the amount of feeding of cloth the cloth feed dog 73 may be adjusted by operation of a lever 75.

Next, a selecting mechanism 77 is provided on the side wall 12*a* of the upright support 12. The aforementioned lockstitching arm shaft 28 and the overlock sewing spindle 45 are designed to be interlocked with a motor 88, which serves as a driving device, through the selecting mechanism 77. This selecting mechanism is principally shown in FIGS. 1 and 3. That is, pulleys 78 and 79 fit in the shaft 28 and spindle 45, respectively, so that the former may be freely rotated with respect to the shaft 28 and spindle 45, respectively, but may not be moved in an axial direction. Clutch members 80 and 81 are connected to the ends of shaft 28*a* and spindle 45*a*, respectively, in a splined manner so that the former may be rotated integral with the spindles, respectively, and may be moved in an axial direction. Mutually opposed surfaces in the pulleys 78 and 79 and the clutch members 80 and 81, respectively, are formed with a pair of concave portions 82 and 83 and raised portions 84 and 85 adapted to be fitted or disengaged from each other. Accordingly, when the raised portion 84 is fitted in the concave portion 82, the pulley 78 and shaft 28 integrally rotate, and when the raised portion 85 is fitted in the concave portion 83, the pulley 79 and spindle 45 integrally rotate. In order to be driven by the motor 88, the pulleys 78 and 79 are connected with a pulley 89 mounted on a rotary shaft of the motor 88 by belts 86 and 87. It will be noted that the motor 88 is mounted on the back of the upright support 12 through a bracket 90.

In the operation of lockstitching of clothes using the sewing machine as constructed above, the selecting mechanism 77 may be operated so that rotation of the motor 88 is transmitted only to the arm shaft 28 for lockstitching. The head 15 is placed to assume a position as shown in FIG. 1 with respect to the arm frame body 14 and secured by the fastening handle 21. When the motor 88 is rotated in a state as described above, the lockstitching for clothes may be accomplished by the lockstitch mechanism 24 entirely similarly to a conventional lockstitch sewing machine and in a state as indicated by full line in FIG. 6.

Figure 4:
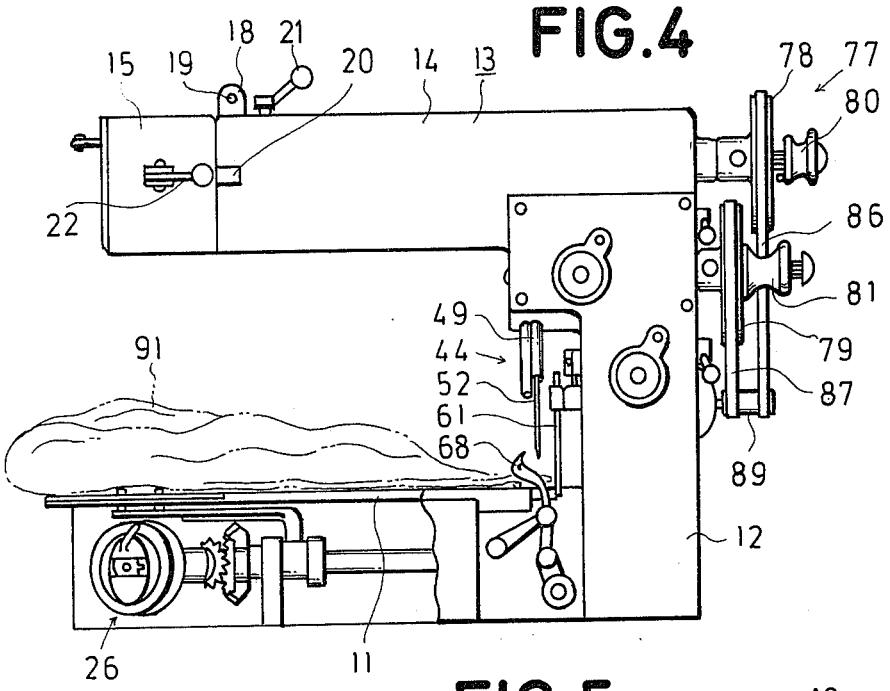
FIG. 4 is a front view showing the state of the sewing machine in the case of overedge stitching.
Figure 5:
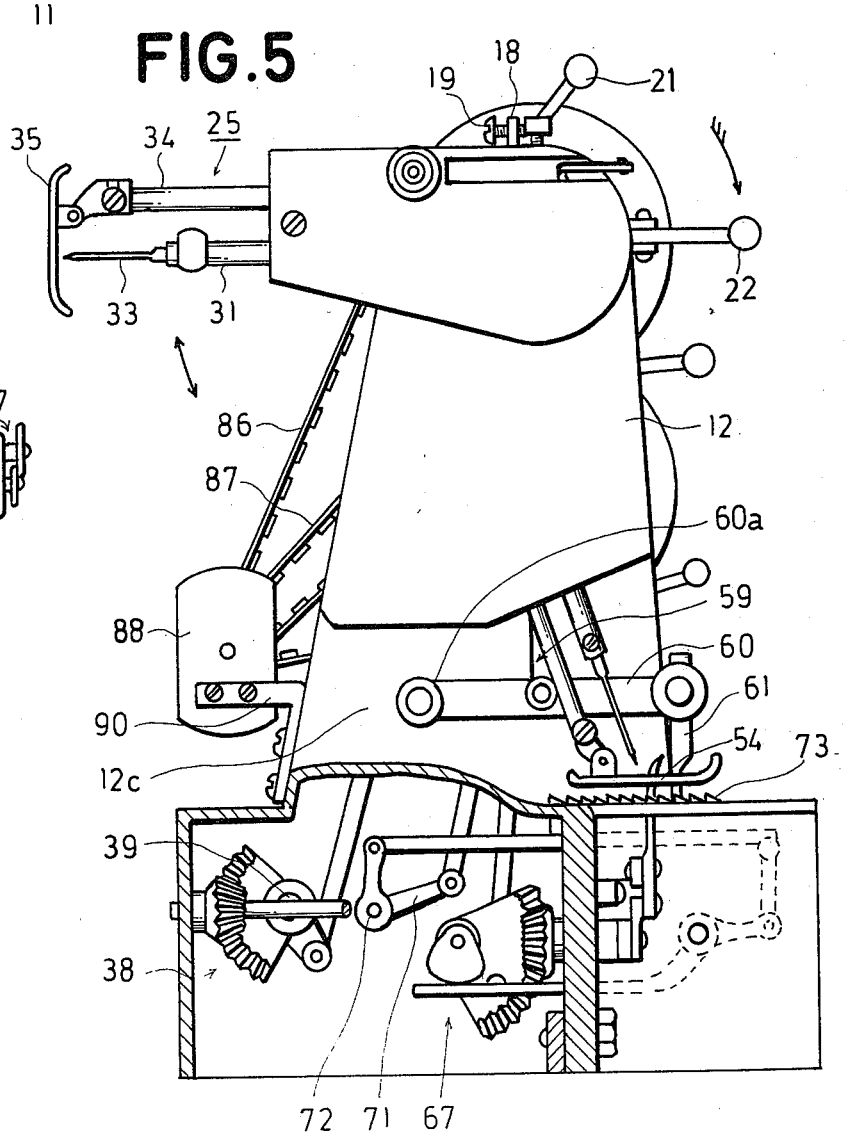
FIG. 5 is a side view on the left side, partly in section, showing the state similar to that of FIG. 4.

Next, in the operation of overedge stitching of clothes, the selecting mechanism 77 may be operated so that rotation of the motor 88 is transmitted only to the spindle 45 for overedge stitching. The head 15 is placed to assume a position as shown in FIG. 5 with respect to the arm frame body 14 and secured by the fastening handle 21. When the motor 88 is rotated in a state as described above, the overedge stitching for clothes may be accomplished by the overedge stitching mechanism 44 entirely similarly to a conventional overedge sewing machine and in a state as indicated by phantom line. In this case, even if the upper mechanism 25 in the lockstitch mechanism 24 is disposed at the foremost end of the arm frame 13, it is positioned greatly withdrawn from the upper surface of the bed 11 as shown in FIG. 5. Hence, the upper mechanism 25 will not stand in the way of clothes 91 to be overedge stitched as shown in FIG. 4. This facilitates the overedge stitched work.

Figure 6:
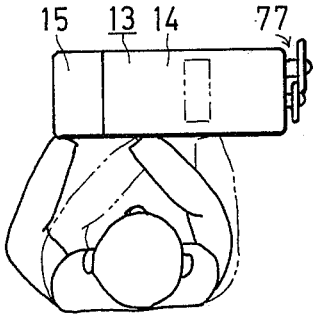
FIG. 6 is a plan view showing the state where lockstitching and overedge stitching are alternately carried out.

It should be appreciated that in alternately carrying out the lockstitching work and overedge stitching as previously mentioned, the lockstitch mechanism 24 and the overedge stitching mechanism 44 are positioned with respect to the machine frame 10 as previously mentioned in the present sewing machine, so that either way of sewing may be initiated immediately only by slight movement of hand as shown in FIG. 6.

Also, in this case, either sewing mechanism 24 or 45 may merely be moved by means of the selecting mechanism 77. Accordingly, the driving force of the motor 88 required is not very much. Further, there prevention of accidents involved in a case, for example, where clothes to be lockstitched erroneously get entangled in the overedge stitching mechanism 44 during the operation of lockstitching sewing.

Moreover, since the upright support 12 is interposed between the lockstitch mechanism 24 and overstitch stitching mechanism 44, which are positioned to left of the upright support 12, and the selecting mechanism 77, which is positioned opposite thereof, clothes may be moved by the left hand and at the same time, the selecting mechanism 77 may be operated by the right hand, during the operation as mentioned above.

Figure 7:
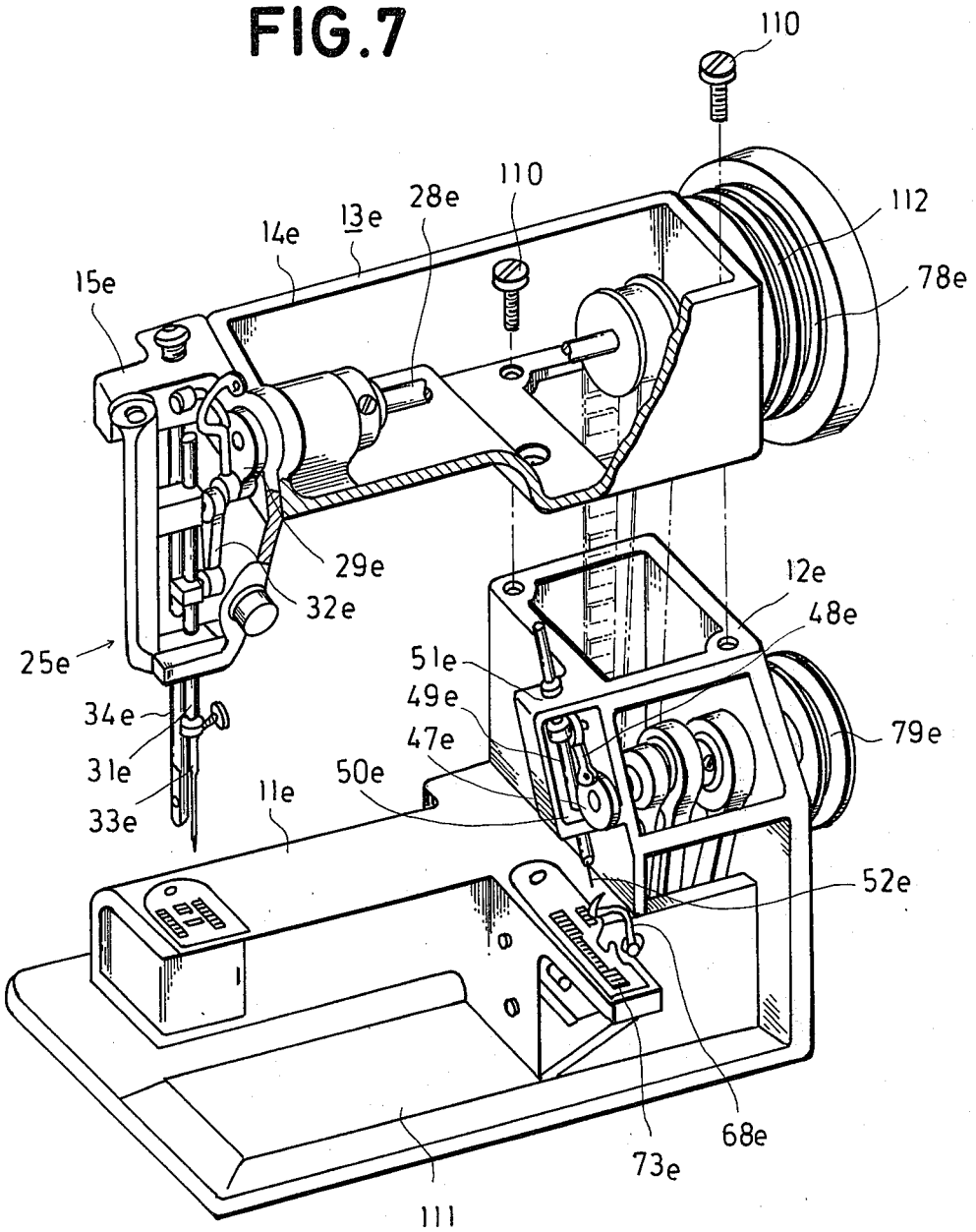
FIG. 7 is an exploded perspective view showing a modified form of embodiment.
Figure 8:
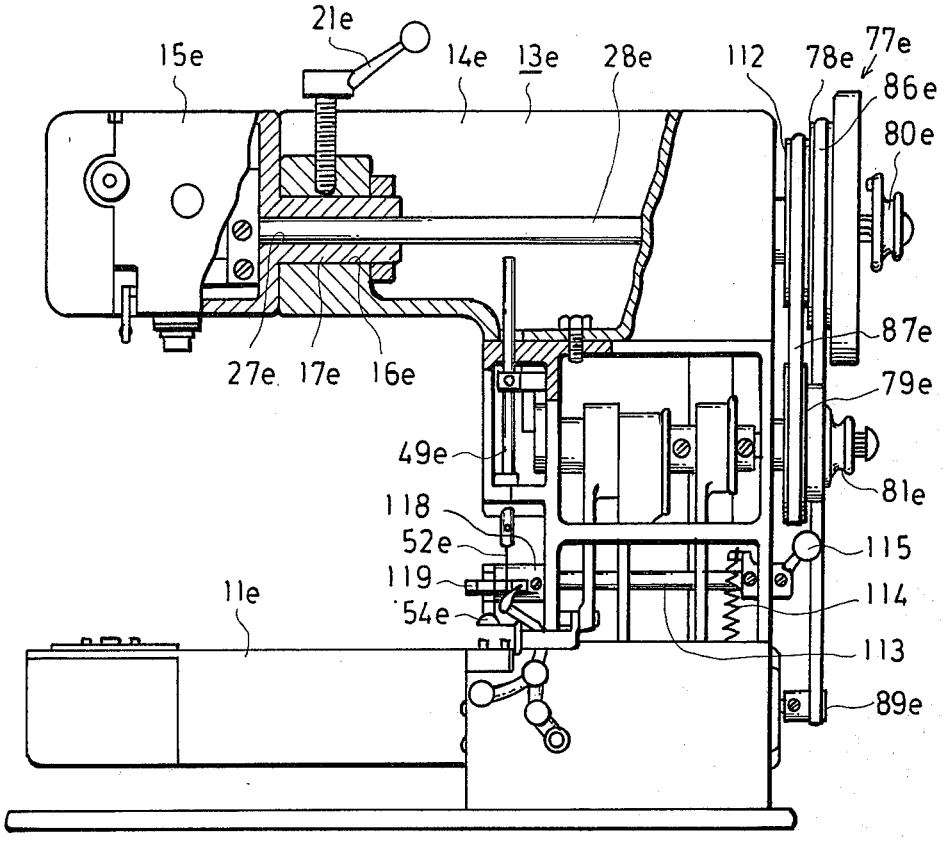
FIG. 8 is a front view, partly in section, showing the state where the overedge stitching is carried out by the sewing machine shown in FIG. 7.

Next, FIGS. 7 and 8 illustrate a different form of embodiment. Those sewing machines shown in these figures are so designed that an upright support **12*e* is provided separately from an arm frame 13*e*, both being connected by a bolt 110** as a connecting member.

A bed **11*e* is designed in the form of an elongated structure and being raised from a base 111** so that the sleeves of a coat may be conveniently sewn.

In addition, in the selecting mechanism **77*e*, a belt 87*e* used to rotate a pulley 79*e* is passed over a pulley 112 secured to a pulley 78*e***.

In such sewing machines wherein the upright support **12*e* is separated from the arm frame 13*e*, it is possible to easily perform machining of a hole for supporting a needle bar 49*e* in an overedge stitching mechanism 44*e*, machining a hole for supporting a spindle 45*e* for overedge stitching, machining a hole for carrying a base of a looper 68*e*** or work for affixing various parts to these holes.

Those parts in sewing machines shown in FIGS. 7 and 8 considered to have identical or equal constructions in terms of function to those sewing machines shown in FIGS. 1 through 6 are indicated by reference numerals with a suffix e added thereto to avoid the need for duplicate description.

Figure 9:
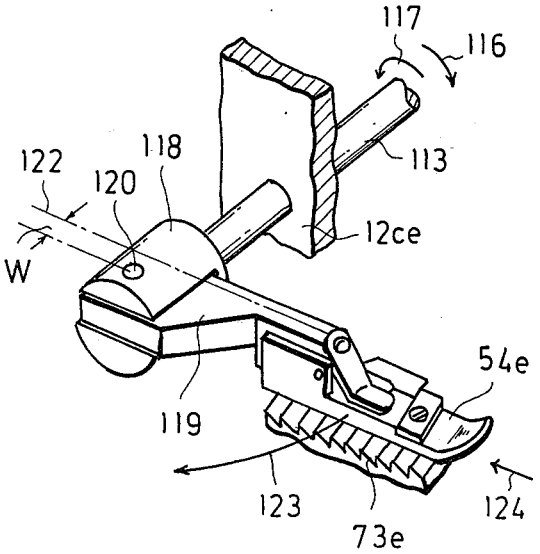
FIG. 9 is a perspective view of a cloth holding section.

Next, FIG. 9 shows a detailed construction of a presser foot in the overedge stitching mechanism **44*e* of the sewing machine shown in FIG. 8. A shaft 113 supported on an upright support 12*ce* is normally biased by a spring 114 shown in FIG. 8 in a direction as indicated by the arrow 116. The shaft 113 may be rotated in a direction as indicated by the arrow 117 by means of a handle 115 mounted on one end thereof. The shaft 113 has a bracket 118 secured to the other end thereof, and a holder member 119 for holding a presser foot 54*e* is pivotally mounted on the bracket 118 by a pin 120. The aforesaid pivotal position is displaced from a center line 122 of the presser 54*e*** through a distance as indicated at W.

The abovementioned construction, in which the cloth holder **54*e* is supported, allows the presser foot 54*e*, when a thread is passed through a needle 52*e* shown in FIG. 8, to be moved in a direction as indicated by the arrow 123**, thus facilitating work of passing a thread through a needle.

Further, where the presser foot **54*e* is then returned to a position as shown in FIG. 9 for sewing of clothes, when the clothes are fed in a direction as indicated by the arrow 124, the presser foot 54*e*** is always maintained in a position as shown by the presence of the aforesaid distance W.

Figure 10:
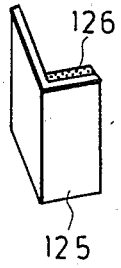
FIG. 10 is a perspective view of a cover for covering an overedge stitching mechanism.
Figure 11:
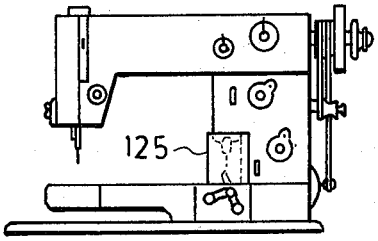
FIG. 11 is a front view showing the state where the overedge stitching mechanism is covered with the cover.

FIG. 10 shows a cover 125 for covering the overedge stitching mechanism. In the operation of the lockstitching, the cover 125 covers up the overedge stitching mechanism as shown in FIG. 11 to prevent clothes from being entangled in the needle or other parts in the overedge stitching mechanism. The cover 125 may be attached to the upright support by placing a magnet 126 affixed to the cover 125 on the upright support or other suitable stop means.

Figure 12:
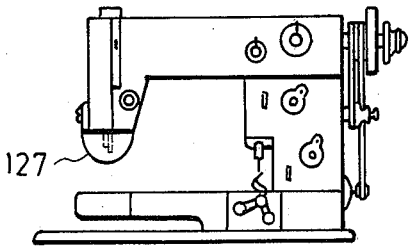
FIG. 12 is a front view showing the state where an upper mechanism in a lockstitching mechanism is covered by a cover.

Finally, FIG. 12 shows a state where the upper mechanism in the overlock stitching mechanism is covered up by a cover 127. In the operation of overedge stitching, the upper mechanism may be covered up by the cover 127 as just mentioned to thereby prevent clothes from being entangled in the needle in the upper mechanism or other parts. It should be noted that the cover 127 may be mounted in a manner similar to that is accomplished when the cover 125 is mounted.

What is claimed is:

1. In a sewing machine of the kind having:

(a) a bed (b) an arm frame opposed to said bed and positioned above said bed and disposed substantially parallel with said bed, (c) a support extending upright from said bed to support one end of said arm frame, (d) an upper lockstitch mechanism including a needle bar located at a free end of said arm frame, (e) a lower lockstitch mechanism disposed below said upper lockstitch mechanism and within said bed, the improvement which comprises:

(i) an overedge stitching mechanism disposed within said upright support between said bed and said arm frame, (ii) said arm frame comprises an arm frame body fixed to said upright support, and a head connected to a free end of said arm frame body and provided with said upper lockstitch mechanism, means selectively rotatably connecting said head with respect to a longitudinal axis of said arm frame body so as to permit said needle bar in said lock-stitching mechanism to be rotated about said axis in a cloth feed direction, whereby said head can be selectively rotated toward and away from said lower lockstitch mechanism.

2. A sewing machine, as claimed in claim 1, wherein a driving means may be connected selectively by a selecting mechanism to a lockstitching shaft connected to said lockstitching mechanism, and to an overedge stitching spindle connected to said overedge stitching mechanism.

3. A sewing machine, as claimed in claim 2, wherein said selecting mechanism is provided on a side wall of said upright support opposite to that from which said arm frame extends.

4. A sewing machine, as claimed in claim 1, wherein said upright support and said arm frame are constructed separately from each other and are integrally connected by a connecting member.

5. A sewing machine, as claimed in claim 1, comprising a cover for covering said overedge stitching mechanism.

6. A sewing machine, as claimed in claim 1, comprising a cover for covering said upper mechanism in said lock-stitching mechanism.

7. A sewing machine comprising:

(i) a frame of generally horizontal U-shape and including a bed, an arm frame disposed opposite said bed and substantially parallel above said bed, and an upright support extending from said bed to support one end of said arm frame, said support including a wall formed with a recess adjacent said bed, (ii) a lockstitching means comprising a needle support bar disposed at a free end of said arm frame and movable up and down, a needle mounted at the lower end of said needle bar, and disposed opposite said recess, an arm shaft positioned substantially horizontally within said arm frame, means connecting said arm shaft and said needle support bar for moving said bar up and down, a shuttle disposed in said bed at a position at which said needle enters said bed, a shuttle driving shaft disposed interiorly of said bed and connected to said shuttle for driving said shuttle, and a connecting means disposed interiorly of said upright support and interposed between said arm shaft and said shuttle driving shaft for rotating said shuttle driving shaft in synchronism with said arm shaft, (iii) an overedge stitching means comprising a needle support bar extending through an upper part of said wall bounding said recess, said bar being movable up and down, a needle mounted on the lower end of said needle support bar, a spindle disposed interiorly of said upright support, means connecting said spindle and said needle support bar for moving said bar up and down, a looper mounted movably in said bed and disposed at at position in which said overedge stitching needle moves downwardly in said recess, a looper driving means disposed interiorly of said bed and connected to said looper for driving said looper, and a connecting means disposed interiorly of said upright support and interposed between said spindle and said looper driving means for operating said looper driving means in synchronism with said spindle, (iv) a driving means, and clutch means associated with said driving means and respectively with said lockstitching shaft and said overedge stitching spindle for selectively coupling said shaft and said spindle with said driving means.

* * * * *